US006999040B2

(12) United States Patent
Robertson, Jr. et al.

(10) Patent No.: US 6,999,040 B2
(45) Date of Patent: Feb. 14, 2006

(54) TRANSVERSE DEVICE ARRAY PHASE SHIFTER CIRCUIT TECHNIQUES AND ANTENNAS

(75) Inventors: Ralston S. Robertson, Jr., Northridge, CA (US); William H. Henderson, Redondo Beach, CA (US); Robert T. Lewis, Vista, CA (US); Ruey-Shi Chu, Cerritos, CA (US); David W. Baker, Tucson, AZ (US); Brian M. Pierce, Moreno Valley, CA (US); David R. Ulmer, Tucson, AZ (US); Romulo J. Broas, Carson, CA (US)

(73) Assignee: Raytheon Company, Waltham, MA (US)

( * ) Notice: Subject to any disclaimer, the term of this patent is extended or adjusted under 35 U.S.C. 154(b) by 181 days.

(21) Appl. No.: 10/464,086

(22) Filed: Jun. 18, 2003

(65) Prior Publication Data

US 2004/0257288 A1 Dec. 23, 2004

(51) Int. Cl.
*H01Q 13/00* (2006.01)
*H01Q 3/00* (2006.01)
*H01P 5/00* (2006.01)

(52) U.S. Cl. ..... 343/772; 333/237; 342/374

(58) Field of Classification Search ..... 343/772, 343/754, 778, 783, 785, 767; 342/371, 374; 333/157, 164, 237, 239

See application file for complete search history.

(56) References Cited

U.S. PATENT DOCUMENTS 4,447,815 A * 5/1984 Chekroun et al. ..... 343/754
4,970,522 A * 11/1990 Niman ..... 342/374
5,266,961 A 11/1993 Milroy
5,412,394 A 5/1995 Milroy
5,483,248 A 1/1996 Milroy
5,598,172 A * 1/1997 Chekroun ..... 343/754
6,064,349 A 5/2000 Robertson

* cited by examiner

*Primary Examiner*—Michael C. Wimer
(74) *Attorney, Agent, or Firm*—Leonard A. Alkov; Karl A. Vick

(57) ABSTRACT

A transverse device array phase shifter includes an over-moded waveguide structure having a top conductive broad wall surface, a bottom conductive broad wall surface and opposed first and second conductive side wall surfaces. At least one transverse device array circuit is positioned in the waveguide circuit. Each circuit comprises a generally planar dielectric substrate having a microwave circuit defined thereon, and a plurality of spaced discrete phase shifter elements. The substrate is disposed within the waveguide structure generally transverse to the side wall surfaces. A bias circuit applies a voltage to reverse bias the phase shifter elements. The transverse device array phase shifter circuit causes a change in phase of microwave or millimeter-wave energy propagating through the waveguide structure. An electronically scanned antenna array employing continuous transverse stubs as radiating elements, with an upper conductive plate structure comprising a set of continuous transverse stubs, and a lower conductive plate structure disposed in a spaced relationship relative to the upper plate structure. At least one transverse device array phase shifter circuit is disposed between selected adjacent pairs of stubs. An electronically tunable antenna array employing continuous transverse stubs as radiating elements and transverse diode array phase shifters, which includes a short circuit termination disposed between the upper conductive plate and the lower conductive plate. At least one transverse device array phase shifter circuit is positioned between the short circuit termination and an adjacent stub to provide tuning.

25 Claims, 4 Drawing Sheets

TRANSVERSE DEVICE ARRAY PHASE SHIFTER CIRCUIT TECHNIQUES AND ANTENNAS

This invention was made with Government support under Contract No. F33615-97-2-1151 awarded by the Department of the Air Force. The Government has certain rights in this invention.

BACKGROUND OF THE DISCLOSURE

A major problem for many years has been the development of a low power consumption, reciprocal and low loss microwave/millimeter-wave phase shifter. Microwave and millimeter-wave phase shifters are commonly realized in a ferrite based, anisotropic configuration or as a discrete switched line phase shifter configuration. Although some digital phase shifters exist at lower frequencies, such phase shifters do not directly apply at high microwave and millimeter-wave frequencies or would subsequently require some type of frequency translation circuits to realize the phase shifting affect. Additionally, the ferrite based units exhibit a hysteresis characteristic in the phase shift phenomena as a function of the bias current pulse. This hysteresis affect requires that two large bias current pulses, of several amps of peak current, be applied to the phase shifter. The magnitude of the bias pulse generally requires external high power, bias electronics. An alternative phase shifter is a transistor based, switched line phase shifter. Insertion loss is an issue, especially at millimeter-wave and high microwave frequencies. Fiber optic phase shifters are also employed but the extensive attenuation of the signal during translation requires substantial signal amplification making such an approach very costly; again this approach is non-reciprocal. Voltage variable dielectric ceramics, like barium strontium titanate, have been used but the thousands of volts required for biasing and the high insertion loss make this a poor choice.

Another problem has been the realization of a low cost, electronically scanned antenna (ESA) for applications that could not afford the cost and complexity of either a Transmit/Receive (T/R) module based active array or a ferrite-based phased array to achieve electronic beam scanning. These applications include low cost radars for un-manned air vehicles and communication systems, like point-to-multi-point communication systems.

Electronic scanning of a radiation beam pattern is generally achieved with either Transmit/Receive (T/R) module-based active arrays or ESAs that employ ferrite-based phased arrays. The phase shifter is behind each radiating element in the array. Both methods employ expensive components, expensive and complicated feeds and are difficult to assemble. Additionally, the bias electronics and associated beam steering computer are relatively complex. Other methods to achieve beam steering are the PIN diode based Rotman lens and the voltage variable dielectric lens. The latter employs barium strontium titanate (BST). BST is a voltage variable, dielectric material system to achieve the beam steering. Both require either high current or high voltage (10,000 volts) biasing requirements, as well as having a high insertion loss. The large insertion loss results in a low efficiency and low gain antenna and severely limits the practical application of these technologies for ESAs.

Another problem for many years has been the realization of a broadband standing wave antenna. Although the standing wave antenna is an efficient architecture, the frequency dependent nature of the short circuit termination of that antenna topology limits its usefulness.

SUMMARY OF THE DISCLOSURE

A transverse device array phase shifter is disclosed, which in an exemplary embodiment includes an overmoded waveguide structure having a top conductive broad wall surface, a bottom conductive broad wall surface, and opposed first and second conductive side wall surfaces. At least one transverse device array circuit is positioned in the waveguide circuit. Each circuit comprises a generally planar dielectric substrate having a microwave circuit defined thereon, and a plurality of spaced discrete voltage variable capacitance elements, e.g. semiconductor junction devices. The substrate is disposed within the waveguide structure generally transverse to the side wall surfaces. A bias circuit applies a voltage to reverse bias the semiconductor junctions. The transverse device array phase shifter circuit under reverse bias causes a change in phase of microwave or millimeter-wave energy propagating through the waveguide structure.

In another aspect, an electronically scanned antenna array employing continuous transverse stubs as radiating elements is disclosed, with an upper conductive plate structure comprising a set of continuous transverse stubs, and a lower conductive plate structure disposed in a spaced relationship relative to the upper plate structure. At least one transverse device array phase shifter circuit is disposed between selected adjacent pairs of stubs.

In a further aspect, an electronically tunable antenna array employing continuous transverse stubs as radiating elements and transverse diode array phase shifters is disclosed, which includes a short circuit termination disposed between the upper conductive plate and the lower conductive plate. At least one transverse device array phase shifter circuit is positioned between the short circuit termination and an adjacent stub to provide tuning.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1A:
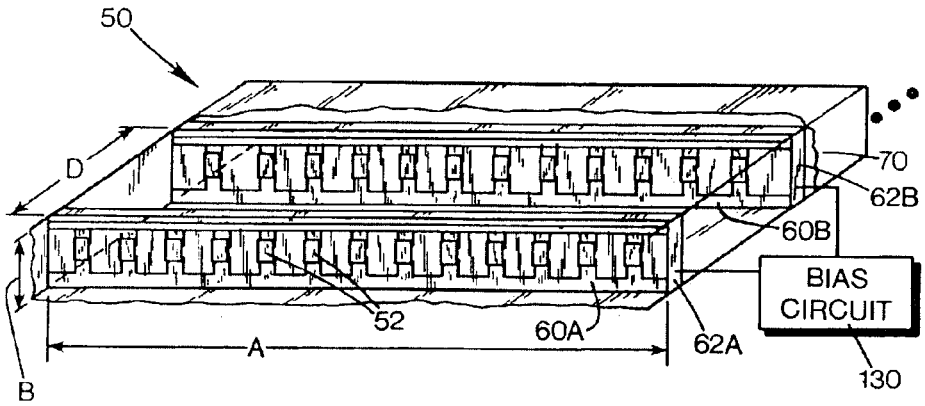
FIG. 1A is an isometric view of an embodiment of a transverse device array phase shifter circuit in accordance with an aspect of the invention.

An aspect of the invention relates to the realization of a microwave and millimeter-wave phase shifter element, referred to herein as a transverse device array (TDA) phase shifter. An exemplary embodiment of a TDA circuit 50 is illustrated in FIG. 1A. The propagation medium of this embodiment is a rectangular waveguide construction.

The phase shifter circuit 50 is a discrete, semiconductor-based phase shifter that employs discrete semiconductor devices 52, such as varactor diodes, Schottky diodes, FETs, or a voltage variable capacitance material as phase shifting elements. In the embodiment of FIG. 1A, the devices 52 are mounted on a dielectric substrate or board of any convenient material, e.g., a glass-loaded Teflon® material, quartz or Duroid®. Two exemplary substrate circuits 60A, 60B are shown in FIG. 1A. The dielectric boards 62A, 62B in this exemplary embodiment are plated on both substrate sides with a metal layer, such as copper. The layer is patterned and then etched to realize microwave circuits arrayed in a "repetitive" circuit configuration with an array of metal contacts for the device/diode attachment. The discrete devices 52 are then bonded at each circuit junction to effect electrical contact.

Figure 1B:
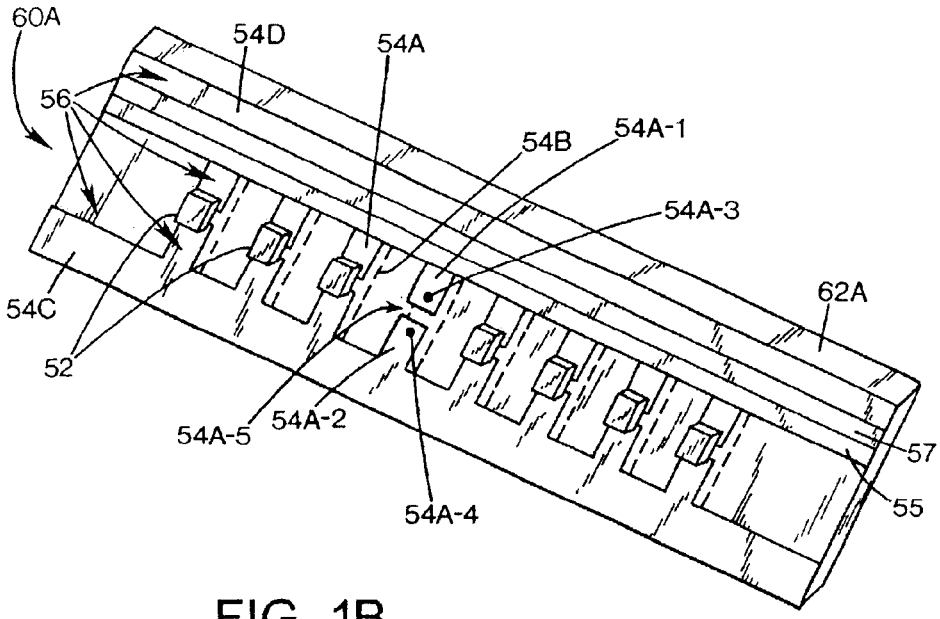
FIG. 1B is a diagrammatic fragmentary view of an exemplary embodiment of a portion of a transverse device array, phase shifter circuit.

A simplified illustration of board circuit 60A is illustrated in FIG. 1B, showing the microwave circuit conductors 54A, 54B on both sides of the board in this embodiment. One diode is omitted from one set of conductors to illustrate the junction or opening 54A-5 between conductor portions 54A-1 and 54A-2 and the metal contacts 54A-3 and 54A-4 to which the diode is bonded. It will be seen that the microwave pattern 56 includes the generally vertically oriented circuit conductors 54A, 54B, a transversely oriented ground conductor strip 54C adjacent the bottom wall of the waveguide, and a transversely oriented conductor strip 54D adjacent the top wall of the rectangular waveguide. The conductor forming the strips 54C and 54D can be wrapped around the bottom and top edges of the substrate board 62A. The metal layer pattern also defines a common bias conductor line 55 connected to each conductor 54A along, but spaced from, the conductor strip 54D adjacent top wall of the waveguide structure by a space 57. The line 55 is connected to a DC bias circuit for applying a reverse bias to the devices 52.

The diode locations are selected based upon electromagnetic mode considerations. The microwave circuit conductor pattern is also selected to provide a desired circuit performance for a given application. Although shown as a vertical strip pattern in FIG. 1, the pattern will vary depending upon the center frequency, bandwidth and amount of phase shift required from the phase shifter. The respective patterns on the two sides of the dielectric substrate for some applications may be different patterns. The diode locations, relative to each other, can be determined during the electromagnetic simulation and design process in an exemplary embodiment. The principal issue is to select an element spacing that insures that the higher order waveguide modes, which are generated when the electromagnetic wave strikes the transverse device array, rapidly attenuate or evanesce away from the array. This evanescent property insures that mutual coupling of the fields of these higher order modes does not occur between successive Transverse Device Arrays. Additionally, the diodes are electrically connected by the bias strip 55 (FIG. 1B) and via the ground path from the phase shifter array to the waveguide housing.

In this exemplary embodiment, the diode array boards 62A, 62B are mounted within a waveguide 70, having a potentially overmoded waveguide cross sectional configuration of height B and width A (FIG. 1A), i.e., the cross section is significantly larger than conventional, single mode rectangular waveguide. Overmoded waveguide is defined as a waveguide medium whose height and width are chosen so that electromagnetic modes other than the principal dominant $TE_{10}$ mode can carry electromagnetic energy. As an example, a conventional single mode, X-band rectangular waveguide, which operates at or near 10 GHz, has cross sectional dimensions of 0.900 inches wide by 0.400" high; (0.90"×0.40"). An exemplary embodiment of an overmoded waveguide structure suitable for the purpose has a cross section of 9.00 inches wide by 0.150" high (9.00"×0.15"). For this embodiment, the waveguide structure width can support several higher order modes. The height for this embodiment this selected based upon elimination of higher order modes that can be supported and propagated in the "B" dimension. Other waveguide dimensions can be used.

It is well known that overmoded waveguide is an extremely low loss propagation environment. This low loss propagation medium is well suited for the phase shifter circuit. The waveguide media can be filled with any homogenous and isotropic dielectric material. The medium can be filled with a low loss plastic like Rexolite® or may also be air-filled.

Figure 1C:
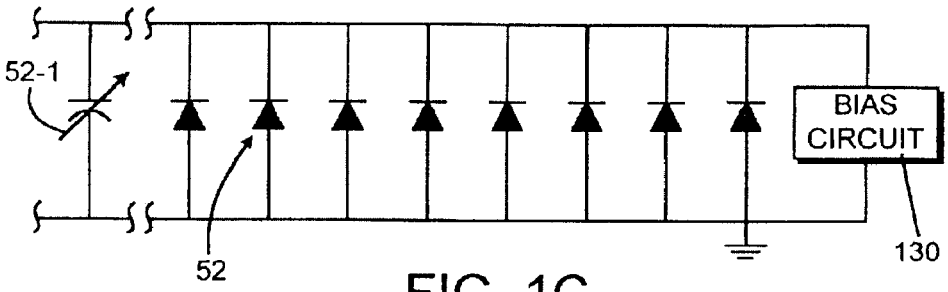
FIG. 1C is a DC schematic circuit diagram of an exemplary embodiment for one transverse device array, phase shifter circuit.

FIG. 1C illustrates an exemplary DC schematic equivalent circuit diagram of one array phase shifter circuit, wherein the semiconductor devices 52 are connected in a parallel arrangement to a DC bias circuit 130. The devices 52 are illustrated in this embodiment as diodes, which are biased to a reverse bias condition by circuit 130; one element 52-1 is more generally shown as a variable capacitance. The circuit 130 is preferably capable of applying selectable reverse bias voltages across the parallel arrangements of devices 52. The DC bias can be brought into the phase shifter circuit 50 from either the top or side of the waveguide structure. For example, the circuit board pattern can include a DC return line along the bottom of the circuit board, and a top line, e.g. line 55 (FIG. 1B) adjacent the top of the board.

When a bias voltage is applied so as to reverse bias the semiconductor "PN" junction, i.e. a diode, a depletion region is formed. As is known, the width of the depletion region acts to mimic the separation distance between two, charged parallel metal plates of a capacitor. As the bias is increased in a reversed bias manner, the depletion region enlarges, resulting in a reduction in both the capacitance and the epitaxial series resistance of the device, e.g. a varactor diode. This voltage variable device is coupled to the microwave/millimeter-wave energy within the waveguide circuit via the RF conductor pattern formed on the substrate. As the energy propagates down the waveguide and encounters the transverse device array phase shifter, the change in capacitance introduced by the voltage variable capacitor element results in a phase shift of the energy. The low series resistance of the device results in low propagation loss. It should also be noted that this exemplary embodiment of the phase shifter, unlike some phase shifter architectures, is an "analog" implementation. Each bias voltage for the device corresponds to one value of capacitance in a continuous, albeit, nonlinear capacitance versus voltage relationship. Hence, the transverse device array phase shifter enables a continuous variation in phase shift with bias voltage.

Since the phase shifter circuits 60A, 60B are assembled in a cascaded configuration, additional phase shift is realized by merely inserting additional phase shifter circuits at a spacing D (FIG. 1A). As an example, consider a phase shifter composed of two, identical Transverse Device Arrays. A starting point separation distance in an exemplary embodiment would be a quarter of a guide wavelength ($\lambda_g/4$) and then the final separation would be determined via an iterative finite element simulation process. The analytical process would conclude when the desired performance was achieved for the phase shifter.

The spacing of the devices 52 on a given substrate is based upon a minimization of reflected energy at the center frequency of operation, i.e., realization of a RF matched impedance condition. In a typical embodiment, the devices 52 are equally spaced on the board. The diode spacing, relative to each other, is determined during the electromagnetic simulation and design process. The principal issue is to select an element spacing that insures that the higher order waveguide modes, which are generated when the electromagnetic wave strikes the transverse device array, rapidly attenuate or evanesce away from the array. This evanescent property insures that mutual coupling of the fields of these higher order modes does not occur between successive Transverse Device Arrays. Each phase shifter circuit board can be mounted in shallow channels or grooves (not shown) formed in the bottom and top walls of the waveguide structure, Clearance between the top wall and the DC bias line is provided so that the DC line is not shorted to the top wall.

The TDA circuits 60A, 60B have been shown in FIGS. 1A–1B as oriented in a generally perpendicular fashion relative to the top and bottom wall surfaces of the waveguide structure, in a shunt-type of arrangement.

One way to view the transverse device array phase shifter structure as an RF circuit is as a bandpass filter network. The incorporation of the semiconductor devices 52 changes the group delay of the incident RF signal. The change in the semiconductor device reactance causes a change in the phase of the propagating signal.

For exemplary transverse device array phase shifter circuits employing varactor diodes as the semiconductor device 52, the capacitance and RF series resistance are important factors to improve performance. For an exemplary application, a varactor diode with a hyperabrupt dopant density profile can be employed. Capacitance and RF series resistance of the varactor diode for this embodiment are important characteristics for an efficient phase shifter. Preferably, for an exemplary frequency of operation, the capacitance change with bias is at least 4:1. The zero voltage, RF series resistance of the diode is less than 4 ohms to enable a low dissipative loss for the phase shifter. Another important factor for this embodiment was the undepleted epitaxial, series resistance versus reverse bias voltage characteristic. For a Ku band TDA phase shifter, a GaAs, flip-chip hyperabrupt varactor diode was found to be suitable for the purpose. Other semiconductor devices can alternatively be employed.

Since the phase shifter architecture in an exemplary embodiment employs readily available and low cost materials, embodiments of the phase shifters can be inexpensive compared to other phase shifter implementation methods. The phase shifter is a reciprocal phase shifter that is constructed in a potentially overmoded waveguide structure. The wavelength of the dominant waveguide mode emulates the Transverse Electromagnetic Mode (TEM) mode due to the large "A" dimension (FIG. 1A) of the waveguide. The potentially overmoded waveguide provides an inherently low loss propagation medium. In an exemplary embodiment, the nature of the diode incorporation within this medium effects the phase shift in a reciprocal manner and at the same time provides low insertion and dissipative loss. The fundamental resistive loss of commercially available diodes is in the three (3) ohm range with diodes with RF resistance of <1.5 ohms possible. The Transverse Electromagnetic Mode (TEM)-like wave propagation and the low series resistance of an exemplary varactor diode with frequency lends the phase shifter architecture to high frequency applications. In an exemplary embodiment, the bias voltage of the phase shifter is less than 20 volts and requires negligible bias current and negligible DC power. Furthermore, since the phase shifter elements 52 are operated in the reverse biased and low voltage condition, the current required to change the phase shifter and operate the unit is negligible. The subsequent power draw is negligible and hence substantially simplifies the associated bias electronics.

Advantages of exemplary embodiments of this new phase shifter architecture can include one or more of the following. The phase shifter is reciprocal, i.e., the phase shifter is electrically identical in both the forward and reverse direction. It is applicable at microwave and millimeter-wave frequencies. Since the phase shifter architecture employs readily available and low cost materials, the phase shifter can be manufactured easily and at a low cost. The phase shifter bias voltage for an exemplary embodiment is extremely low, typically 20 volts for a varactor diode, although the exact range is device dependent. Since the diode is reverse biased, unlike a PIN diode, the bias current required is in the nanoampere range; hence the bias electronics are simple. The low voltage and virtually nonexistent current makes the phase shifting response time to be less than 10 nanoseconds in one exemplary embodiment. The phase shifter provides phase shift and low loss. Additional phase shift is realized by cascading more transverse device array, phase shifter elements. In addition to conventional phase shifter applications in MW/MMW circuit applications, the unit lends itself to new electronically scanned antenna configurations.

Figure 2A:
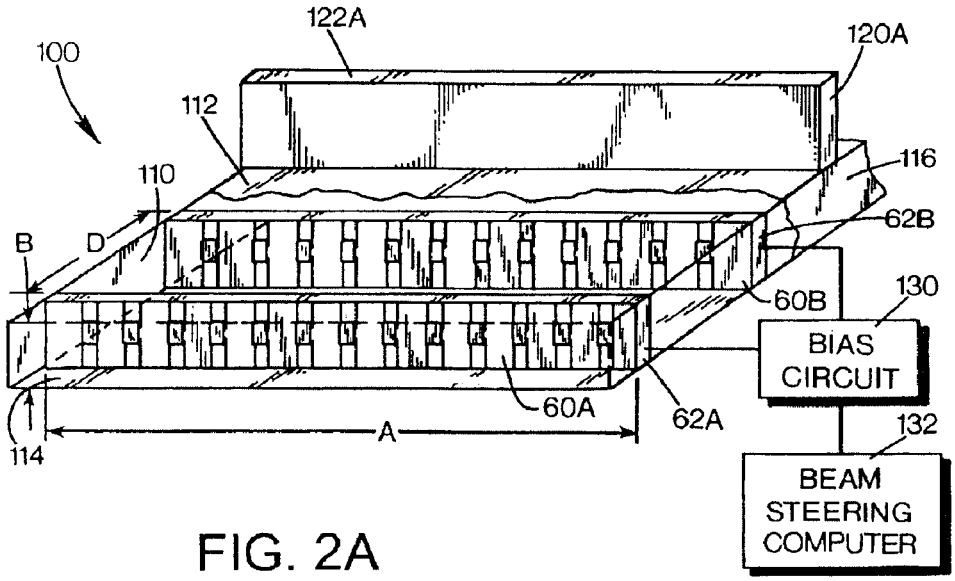
FIG. 2A is an isometric view of an embodiment of a continuous transverse stub (CTS) electronically scanned antenna (ESA) employing transverse device array phase shifter circuits.
Figure 2B:
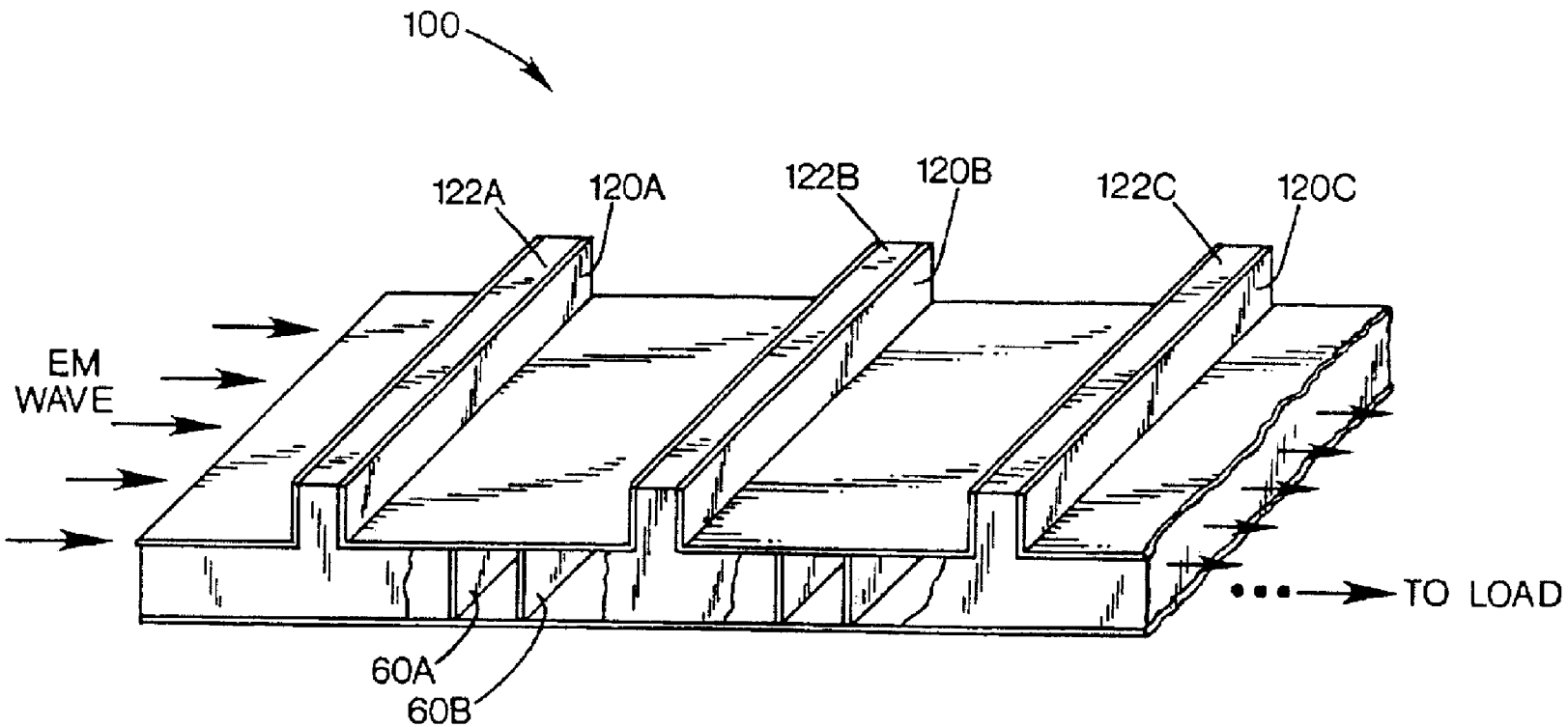
FIG. 2B is an isometric view of the ESA of FIG. 2A with control systems.

Another aspect relates to the realization of a microwave and millimeter-wave active electronically scanned antenna, referred to herein as the Transverse Device Array CTS Electronically Scanned Antenna (TDA CTS ESA). An exemplary embodiment of a TDA CTS ESA 100 is illustrated in FIGS. 2A–2B.

This propagation environment in an exemplary embodiment is the same RF environment employed in Continuous Transverse Stub (CTS) antennas, described for example in U.S. Pat. No. 5,483,248, U.S. Pat. No. 5,266,961 and U.S. Pat. No. 5,412,394, the entire contents of which are incorporated herein by this reference. Another embodiment of a CTS-based ESA, called the Electronically Scanned Semiconductor Antenna, is described in U.S. Pat. No. 6,064,349, the entire contents of which are incorporated herein by this reference.

The antenna 100 includes a pseudo-parallel plate structure 110 comprising a top conductive plate 112, a bottom conductive plate 114 and side conductive plates 116. As with the phase shifter circuit of FIGS. 1A–1C, the spacing of the top and bottom plate structures is selected to cut off multi-mode propagation in the "B" dimension of the waveguide. As is known for CTS arrays, the array includes a plurality of spaced transverse stubs, e.g. stub 120A which is formed in the top plate structure, and which includes the top surface 122A from which the conductive material is removed. One or more phase shifter circuits such as circuits 60A, 60B are positioned in the structure 100 as illustrated in FIGS. 2A and 2B.

A bias circuit 130 is connected to each phase shifter circuit to provide the reverse bias for phase shifting operation. A beam steering computer 132 controls the bias circuit 130 to provide the appropriate reverse bias to the phase shifter, which in turn applies the appropriate uniform progressive phase across the array, thereby positioning the antenna beam.

As described above regarding FIGS. 1A–1C, the phase shifter employs a voltage variable device, e.g. a varactor diode, to achieve a voltage variable capacitance. The voltage variable device is coupled to the microwave/millimeter-wave energy within the propagation circuit via the phase shifter circuit. As the energy propagates down the waveguide and strikes the phase shifter circuit, the change in the capacitance results in a change in the phase of the energy with low propagation loss. Since the phase shifter circuits in this exemplary embodiment are assembled in a cascaded configuration, additional phase shift is realized by merely adding additional phase shifter circuits. The phase shifter circuits are then placed between successive CTS radiators, i.e. the stubs 120, in the CTS antenna array. The CTS radiators couple out energy from the edges 122 and radiate the desired antenna pattern. The TDA CTS ESA is generally designed in a traveling wave embodiment; i.e. the antenna is terminated in a matched load. The phase shifters apply a uniform progressive phase shift on each of the radiating stub elements. This phase progression in this exemplary embodiment results in a 1-dimensional (1-D) scanning of the antenna pencil beam pattern. Since, the phase shifter circuits are reciprocal, the radiation pattern is reciprocal, i.e., transmit and receive patterns are identical. Additionally, since the diodes in this exemplary embodiment are operated in the reverse biased and low voltage condition, the current required to change the phase shifter value and the corresponding beam location is negligible. The subsequent power draw is negligible and consequently the beam steering computer and bias circuits are simple. The result is an active phased array, which requires no T/R modules, and enables a limited 1-dimensional electronic beam scan.

One example embodiment of the beam steering configuration would be a computer controlled digital-to-analog (D/A) circuit card. These cards are commercially available and in an exemplary implementation generate output voltages from −10 volts to +10 volts. The exact output value is determined by the computer software commands. Since the diodes operate from 0 volts to some value, say +20 volts, a conventional operational amplifier-based voltage level shifter translates the D/A output from −10 v/+10/v to 0 v/20 v. The TDA CTS ESA system is biased to a number of beam locations and the voltage versus beam locations are recorded. The resultant data is then easily curve fit and represented by a polynomial function. This function is then used in the beam steering computer control to provide accurate beam pointing.

The phase shifting element shares the same electromagnetic environment as the radiating element, hence the elimination of extraneous loss mechanisms, which are generally encountered in other antenna system architectures. The physics of the operation lends itself to reciprocal operation, namely, transmit and receive beams are identical. In an exemplary embodiment, the ESA works off a low voltage and, in an exemplary embodiment, nanoampere bias supply. Exemplary embodiments of the TDA CTS ESA employ simple, low cost materials and is simple to assemble.

Finally, another problem with traveling wave antenna designs is the fact that the antenna beam will move with changes in frequency. In high resolution, synthetic aperture radar (SAR) applications, a broadband chirped frequency waveform is employed within a radar pulse. Application of a time dependent voltage ramp on the phase shifter circuit (60A) by the bias circuit (130) dynamically compensates for this instantaneous beam movement. In other words, the beam walk associated with traveling wave antennas is easily mitigated with a TDA CTS ESA implementation.

Advantages of embodiments of the TDA CTS ESA include one or more of the following. The TDA CTS ESA achieves efficient and reciprocal electronic beam scan in an extremely simple manner and is applicable at both microwave and millimeter-wave frequencies. Simple and low cost manufacturing materials and methods are used to implement the ESA. Both the phase shifter and the antenna are architecturally simple. The antenna beam can be scanned with a bias voltage of less than 20 volts, in an exemplary embodiment. Since the diodes are reverse biased, the bias current required is in the nanoampere range; hence the bias electronics and beam steering computer are simple since the beam position is directly related to the device bias voltage. The low voltage and virtually non-existent current makes beam steering available with response times of typically less than 10 nanoseconds. Additional, beam steering is realized by cascading more phase shifter elements within the array. The TDA CTS ESA solves the problem of realizing a limited, 1-D electronic beam scan in an extremely low cost manner. Since the beam steering is achieved with diodes, e.g. varactor diodes, or a voltage variable capacitor surrogate, the bias electronics are reduced to a simple low power source. The current and power are negligible and the entire beam scan range is achieved with a bias change of 0–20 volts. The TDA CTS ESA has application in airborne SAR and ground moving target information (GMTI) radars, communications and ground-based to satellite communication links.

Another aspect relates to a capability of electronic tuning of a standing wave embodiment of a CTS array. This aspect substantially increases the bandwidth of standing wave antennas. In accordance with this aspect, a transverse device array phase shifter is incorporated within the TDA CTS ESA architecture between the last radiator element and the short circuit termination. This last phase shifter provides circuit tuning and eliminates the frequency dependent breakdown of the antenna radiation pattern, which is normally present in standing wave antenna designs.

Most CTS antennas and in particular the TDA CTS ESA are realized in a traveling wave configuration, i.e. the antenna is terminated in a load. This termination increases the antenna bandwidth, enables electronic beam scan, as described earlier, but has a reduction in efficiency due to the energy lost to the terminating load. A standing wave antenna, which is terminated in a short circuit radiates all the energy, less phase shifter loss, but does not scan. The short circuit ensures good efficiency, since no power is dissipated in the load, a symmetrical aperture distribution and a stable beam location. However, the short circuit also insures an inherently frequency dependent standing wave pattern within the propagation region and bandwidth limitations for this fixed beam design. As the frequency changes, the electrical location of the short circuit changes, as does the electrical position between the radiators. This phenomenon destroys the antenna phasing and the beam pattern. Although the CTS stub is an inherently broadband radiating element, the frequency dependence of the electrical position of the short circuit termination relative to the radiators and the radiator locations relative to each other, severely limits the antenna suitability for standing wave applications.

Figure 3:
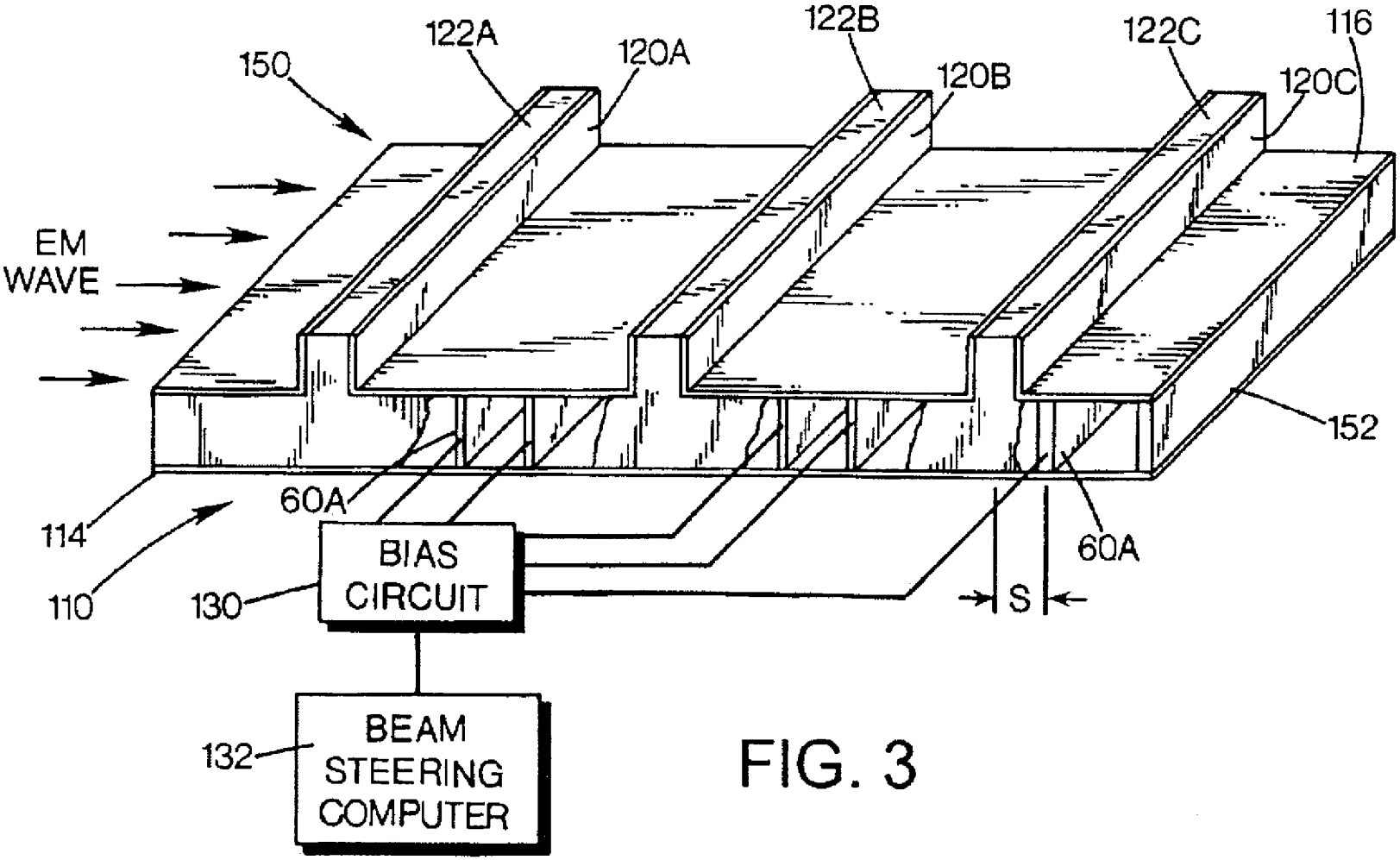
FIG. 3 is an isometric view of an embodiment of a transverse device array, electronically tuned CTS antenna in accordance with a further aspect.

An exemplary embodiment of an electronically tuned TDA CTS antenna 150 is illustrated in FIG. 3. The antenna 150 includes a parallel plate structure 110 comprising a top conductive plate 112, a bottom conductive plate 114 and opposed side conductive plates 116 as with the embodiment of FIG. 2. As with the TDA CTS ESA circuit of FIGS. 2A–2B, the spacing of the top and bottom plates is selected based upon elimination of higher order modes that can be supported in the "B" dimension. As in the case of the TDA CTS ESA, this standing wave antenna includes a plurality of spaced transverse stubs, e.g. stubs 120A, 120B, 120C, which is formed in the top plate structure. These stubs include edges 122A, 122B and 122C from which the conductive material is removed. In accordance with this aspect of the invention, a transverse device array phase shifter circuit 60A is positioned in the structure 150 transverse to the top, bottom and side plates; illustrated in FIG. 3. The phase shifter is spaced between the short circuit termination, defined by conductive wall 152, and the last radiator element. The exact position of the phase shifter Is based upon the center frequency and the dynamic range of phase shift compensation required for a given application. The distance "S" from the center of the last radiator, 120C, to the short is generally selected as a half guide wavelength ($\lambda_g/2$) at the center frequency of operation.

The combination of the TDA CTS ESA embodiment 150 with the TDA Phase Shifter 60A and a short circuit 152 eliminates frequency degradation for the fixed beam antenna. As the frequency is changed, the effective electrical location of the short circuit 152 and the relative phasing of the radiators can be adjusted by changing the reflection phase shift of the phase shifter 60A. This bias process can be effected either for a stepped frequency operation or dynamically within the radar pulse. The result is a broadband standing wave antenna pattern. Since the phase shifter arrays are assembled in a cascaded configuration, additional phase shift is realized by merely adding additional phase shifters between the radiators and prior to the short circuit termination. Furthermore, since the phase shifter is reciprocal, the reciprocity of the antenna is maintained, i.e., transmit and receive patterns are identical.

It should be noted that this same technique is applicable to other standing wave, waveguide architectures and is not limited to the CTS configuration.

Advantages of exemplary embodiments of the CTS configuration with the transverse device array, phase shifter include one or more of the following. Beam walk is eliminated for radars that employ broad instantaneous bandwidths. The low cost aspects of both the CTS antenna and the phase shifters are simultaneously realized with this implementation. The TDA Electronically Tuned CTS Antenna achieves efficient and reciprocal operation for broadband standing wave antennas. It is applicable at both microwave and millimeter-wave frequencies.

It is understood that the above-described embodiments are merely illustrative of the possible specific embodiments, which may represent principles of the present invention. Other arrangements may readily be devised in accordance with these principles by those skilled in the art without departing from the scope and spirit of the invention.

What is claimed is:

1. A transverse device array phase shifter, comprising:

a potentially overmoded waveguide structure having a top conductive broad wall surface, a bottom conductive broad wall surface, and opposed first and second conductive side wall surfaces;

at least one transverse device array phase shifter circuit, each circuit comprising a generally planar dielectric substrate having a microwave circuit defined thereon, and a plurality of spaced discrete voltage variable capacitance elements, the substrate disposed within the waveguide structure generally transverse to the side wall surfaces; and a bias circuit for applying a bias voltage to bias the voltage variable capacitance elements;

said at least one phase shifter circuit causing a change in phase of microwave or millimeter-wave energy propagating through the waveguide structure.

2. The phase shifter of claim 1, wherein the voltage variable capacitance elements each comprise a semiconductor junction.

3. The phase shifter of claim 2, wherein the voltage variable capacitance elements each comprise a varactor diode.

4. The phase shifter of claim 2, wherein the bias circuit applies a reverse bias voltage to reverse bias the semiconductor junctions.

5. The phase shifter of claim 4, wherein the bias circuit is adapted to provide a variable reverse bias voltage to change the capacitance of the semiconductor junctions.

6. The phase shifter of claim 1, wherein said at least one transverse device array circuit comprises a plurality of spaced transverse device array circuits disposed in the waveguide structure.

7. The phase shifter of claim 6, wherein each said transverse device array circuit comprises a substrate, and wherein the substrates of the plurality of spaced transverse device array circuits are disposed in a parallel configuration.

8.The phase shifter of claim 1 further comprising a dielectric fill material disposed in said waveguide structure.

9. The phase shifter of claim 1, wherein the substrate of each of said at least one transverse device array circuit is positioned generally transverse to said top wall surface and said bottom wall surface.

10. An electronically scanned antenna employing continuous transverse stubs as radiating elements, the antenna comprising:

an upper conductive plate structure comprising a set of continuous transverse stubs;

a lower conductive plate structure disposed in a spaced relationship relative to the upper plate structure;

at least one transverse device array circuit disposed between a selected adjacent pair of said stubs, each at least one circuit comprising a generally planar dielectric substrate having a microwave circuit defined thereon, and a plurality of spaced discrete voltage variable capacitance elements, the substrate disposed between the upper conductive plate structure and the lower conductive plate structure; and a bias circuit for applying a bias voltage to bias the voltage variable capacitance elements.

11. The antenna of claim 10, wherein the voltage variable capacitance elements each comprise a semiconductor junction.

12. The antenna of claim 11, wherein the voltage variable capacitance elements each comprise a varactor diode.

13. The antenna of claim 11, wherein the bias circuit applies a reverse bias voltage to reverse bias the semiconductor junctions.

14. The antenna of claim 13, wherein the bias circuit is adapted to provide a variable reverse bias voltage to change the capacitance of the semiconductor junctions.

15. The antenna of claim 10, wherein at least one transverse device array circuit comprises a plurality of spaced transverse device array circuits disposed between the plate structure.

16. The antenna of claim 10, wherein each said transverse device array circuit comprises a substrate, and wherein the substrates of the plurality of spaced transverse device array circuits are disposed in a parallel configuration.

17. The antenna of claim 10 further comprising a dielectric fill material disposed between the plate structure.

18. The antenna of claim 10 wherein the substrate of each of said at least one transverse device array circuit is positioned generally transverse to upper plate structure and said lower plate structure.

19. An electronically tunable antenna array employing continuous transverse stubs as radiating elements, comprising:

an upper conductive plate structure comprising a set of continuous transverse stubs;

a lower conductive plate structure disposed in a space relationship relative to the upper plate structure;

a short circuit termination disposed between the upper conductive plate and the lower conductive plate;

at least one transverse device array circuit disposed between said short circuit termination and an adjacent continuous transverse stub, each at least one circuit comprising a generally planar dielectric substrate having a microwave circuit defined thereon, and a plurality of spaced discrete voltage variable capacitance elements and a bias circuit for applying a bias voltage to bias the voltage variable capacitance elements to provide a phase shift to electromagnetic energy propagating in the array.

20. The array of claim 19, wherein the bias circuit applies a variable bias voltage in dependence on an array frequency of operation to provide a phase shift to maintain a generally constant effective electrical distance between said short circuit termination and said adjacent continuous transverse stub as said frequency of operation changes.

21. The array of claim 19, wherein the voltage variable capacitance elements each comprise a semiconductor junction.

22. The array of claim 19, wherein the voltage variable capacitance elements each comprise a varactor diode.

23. The array of claim 21, wherein the bias circuit applies a reverse bias voltage to reverse bias the semiconductor junctions.

24. The array of claim 21, wherein the bias circuit is adapted to provide a variable reverse bias voltage to change the capacitance of the semiconductor junctions.

25. An electronically tunable antenna array employing continuous transverse stubs as radiating elements, comprising:

an upper conductive plate structure comprising a set of continuous transverse stubs;

a lower conductive plate structure disposed in a spaced relationship relative to the upper plate structure;

a short circuit termination disposed between the upper conductive plate and the lower conductive plate;

at least one transverse diode array phase shifter circuit, each circuit comprising a generally planar dielectric substrate having a microwave circuit defined thereon, and a plurality of spaced discrete semiconductor diode elements, the substrate disposed within the plate structure generally transverse to the side wall surfaces, said circuit disposed between said short circuit termination and an adjacent continuous transverse stub; and a bias circuit for applying a reverse bias voltage to reverse bias the diodes.

* * * * *